US010968553B2

(12) United States Patent
Long

(10) Patent No.: US 10,968,553 B2
(45) Date of Patent: Apr. 6, 2021

(54) WATERLESS DYEING MACHINE SUITABLE FOR MIXED FLUID MEDIUM

(71) Applicant: SOOCHOW UNIVERSITY, Suzhou (CN)

(72) Inventor: Jiajie Long, Suzhou (CN)

(73) Assignee: SOOCHOW UNIVERSITY, Suzhou (CN)

( * ) Notice: Subject to any disclaimer, the term of this patent is extended or adjusted under 35 U.S.C. 154(b) by 146 days.

(21) Appl. No.: 16/346,233

(22) PCT Filed: Oct. 25, 2018

(86) PCT No.: PCT/CN2018/111894

§ 371 (c)(1),
(2) Date: Apr. 30, 2019

(87) PCT Pub. No.: WO2020/077666

PCT Pub. Date: Apr. 23, 2020

(65) Prior Publication Data

US 2020/0115836 A1 Apr. 16, 2020

(30) Foreign Application Priority Data

Oct. 16, 2018 (CN) ..... 201811202688.6

(51) Int. Cl.
*D06B 23/14* (2006.01)
*D06P 5/20* (2006.01)
*D06B 23/20* (2006.01)

(52) U.S. Cl.
CPC ..... *D06B 23/14* (2013.01); *D06B 23/205* (2013.01); *D06P 5/2055* (2013.01); *D06B 2700/36* (2013.01)

(58) Field of Classification Search
CPC .. D06B 23/14; D06B 23/205; D06B 2700/36; D06B 23/00; D06B 19/00; D06B 23/20; D06P 5/2055; D06P 1/94
See application file for complete search history.

(56) References Cited

FOREIGN PATENT DOCUMENTS

| | | |
|---|---|---|
| CN | 86107147 A | 6/1987 |
| CN | 1310257 A | 8/2001 |
| CN | 2688735 Y | 3/2005 |

(Continued)

*Primary Examiner* — Michael E Barr
*Assistant Examiner* — Pallavi Chitta
(74) *Attorney, Agent, or Firm* — SZDC Law P.C.

(57) ABSTRACT

The invention discloses a waterless fiber dyeing machine suitable for mixed fluid medium, including a dyeing tank, a carbon dioxide pressurizing system and a polar medium pressurizing system, a fiber loading system, a circulating dyeing system, a carbon dioxide recycling system, a polar medium separating and recycling system and an automatic unloading system. Since there are pressurizing systems and separating and recycling systems for carbon dioxide medium and polar medium, dyeing with the mixed fluid medium is realized in the waterless dyeing tank and the circulating dyeing system thereof; the hydrophobic carbon dioxide fluid medium is effectively modified, so that the dyeing performance and effect of the dye molecules on the hydrophilic natural fiber are improved. The fiber loading system and the unloading system can significantly improve the fiber loading efficiency, the discharging efficiency of the products.

14 Claims, 6 Drawing Sheets

(56) References Cited

FOREIGN PATENT DOCUMENTS

| | | | | | |
|---|---|---|---|---|---|
| CN | 101024922 | A | * | 8/2007 | ..... D06B 9/06 |
| CN | 102817194 | A | | 12/2012 | |
| CN | 104562759 | A | | 4/2015 | |
| CN | 104674386 | A | * | 6/2015 | |
| CN | 104674386 | A | | 6/2015 | |
| CN | 105970526 | A | | 9/2016 | |
| CN | 106835558 | A | | 6/2017 | |
| CN | 106835558 | A | * | 6/2017 | ..... D06P 1/94 |
| DE | 3906724 | A1 | | 9/1990 | |
| EP | 0846803 | A2 | * | 6/1998 | ..... D06B 5/16 |
| JP | 2002371483 | A | * | 12/2002 | |
| KR | 20050111982 | A | | 11/2005 | |
| WO | WO-2015032022 | A1 | * | 3/2015 | ..... D06P 5/02 |
| WO | WO-2018098885 | A1 | * | 6/2018 | ..... D06B 5/16 |
| WO | WO-2018128252 | A1 | * | 7/2018 | ..... D06B 1/02 |

* cited by examiner

WATERLESS DYEING MACHINE SUITABLE FOR MIXED FLUID MEDIUM

This application is the National Stage Application of PCT/CN2018/111894, filed on Oct. 25, 2018, which claims priority to Chinese Patent Application No.: 201811202688.6, filed on Oct. 16, 2018, which is incorporated by reference for all purposes as if fully set forth herein.

TECHNICAL FIELD

The present invention relates to a waterless dyeing machine suitable for mixed fluid medium, which belongs to the technical field of manufacture of pressure vessel and dyeing and finishing equipment for textile.

BACKGROUND

In recent years, under high requirement of environment protection and the environmental policy being carried out strictly by the government, the traditional textile and dyeing industry with high water consumption and large amount of pollutant discharge has encountered unprecedented challenges and development difficulties. Therefore, the development of green and clean manufacturing technologies, especially the waterless dyeing technology without using water as medium, are attracting more and more attention from textile and dyeing enterprises. And supercritical carbon dioxide fluid, as an important part of non-aqueous medium dyeing technology, has attracted much attention because of its unique technical advantages and industrialization feasibility. For example, the carbon dioxide medium has a relatively low critical temperature and critical pressure (31.1° C. and 7.38 MPa), which is non-toxic, non-combustible, non-explosive, colorless, odorless, and has excellent biocompatibility; and the supercritical carbon dioxide fluid has low viscosity, high diffusivity and high penetration, which thus can effectively shorten the processing time; after the dyeing process is finished, it is easy to separate and recycle the medium, and no harmful substance is remained on the processed products, so that the processed products do not need to be dried. These unique advantages and processing characteristics have made the supercritical fluid waterless dyeing technology develop unprecedentedly in recent years. At present, most synthetic fibers, such as polyester, dyed and processed by disperse dyes in supercritical carbon dioxide fluid, can meet commercial standards and requirements, and realize volume production within a certain range.

However, for various types of hydrophilic natural fibers containing a large number of hydroxyl groups, amino groups and the like, in the hydrophobic supercritical carbon dioxide fluid medium, the hydrogen bonds between the macromolecular segments of the fibers cannot be disconnected effectively, thus the fibers cannot be puffed adequately, and the necessary conditions for the diffusion of dye molecules in the fiber cannot be provided. Meanwhile, the hydrophobic supercritical carbon dioxide fluid medium cannot dissolve the polar dyes adequately, causing the various natural fibers cannot be dyed adequately. Therefore, it has always been a fundamental problem hindering the development and application of the dyeing of natural fibers in single supercritical carbon dioxide fluid medium.

At the same time, from the disclosed literature and reports and practical applications, the existing supercritical carbon dioxide fluid equipment systems for textile dyeing processing are only for single carbon dioxide medium. The function of the existing equipment systems is relatively simple, which are only applicable for limited types of fibers. The degree of automation, operation convenience and processing efficiency are far from satisfying the requirement on commercialized production and high efficiency processing of natural fibers and their blends with multi-component varieties. Therefore, this also significantly affects and limits the industrial application of supercritical fluid waterless dyeing technology.

SUMMARY OF THE INVENTION

The present invention provides a waterless dyeing machine suitable for mixed fluid medium, which can effectively realize the processing of various natural fibers, such as waterless dyeing with mixed fluids. It has the advantages of high processing efficiency, wide applicability, simple operation, high intelligence. The system is stable and reliable, without consumption of large amount of water and generation of waste water, which is friendly to the environment.

A waterless dyeing machine suitable for mixed fluid medium comprises a fiber dyeing tank suitable for waterless fiber dyeing with high-pressure mixed fluid; and a carbon dioxide medium pressurizing system for pressurizing carbon dioxide in the fiber dyeing tank;

a polar medium pressurizing system for pressurizing polar medium in the fiber dyeing tank; and a fiber loading system for loading fibers to be dyed in the dyeing tank; and a circulating dyeing system, connected to an inlet and an outlet of the dyeing tank respectively, for circulating mixed fluid medium containing the polar medium and the carbon dioxide medium in the circulating dyeing system and the fiber dyeing tank; and a carbon dioxide separating and recycling system, for separating and recycling carbon dioxide from the mixed fluid medium discharged from the fiber dyeing tank after dyeing;

a polar medium separating and recycling system, for separating and recycling polar medium from the mixed fluid medium discharged from the fiber dyeing tank after dyeing; and an automatic unloading system, for unloading dyed fibers in the fiber dyeing tank.

Further, the fiber dyeing tank includes an inner matched yarn cage and a pressure bearing tank body.

Further, the carbon dioxide medium pressurizing system comprises a mass flow meter, a booster pump and a carbon dioxide storage tank connected in series, wherein the fiber dyeing tank is in communication with the mass flow meter.

Further, the polar medium pressurizing system comprises a polar medium evaporator and storage unit, a bidirectional gas medium booster pump and a gas medium mass flow meter connected in series, wherein the gas medium mass flow meter is in communication with the fiber dyeing tank.

Further, the fiber loading system includes an external mechanical loading mechanism, for loading fibers to be dyed to the fiber dyeing tank.

Further, the circulating dyeing system comprises a bidirectional mixed fluid medium circulation pump, a heat exchanger and a flow meter connected in series, wherein the fiber dyeing tank, the bidirectional mixed fluid medium circulation pump, the flow meter, the heat exchanger, the fiber dyeing tank are connected in series.

Further, the carbon dioxide separating and recycling system comprises a heat exchanger, a pressure relief pump, a dye separating unit, a mixed fluid separating unit and a condenser connected in series, wherein the heat exchanger is connected to the fiber dyeing tank, and the condenser is connected to the carbon dioxide storage tank.

Further, the polar medium separating and recycling system includes a pipeline for connecting the mixed fluid separating unit and the polar medium evaporator and storage unit.

Further, the automatic unloading system includes a suction cover with negative pressure, a fiber conveying pipe and a fiber picking mechanism, wherein the suction cover with negative pressure can cooperate with an opening of the pressure bearing tank body, and the suction cover with negative pressure is connected to an external fan through the fiber conveying pipe.

Further, the matched yarn cage is made of a surface material which is non-conductive, and comprises a cylindrical cage body and a hollow cage column; the surface and bottom of the cylindrical cage body and the hollow cage column are provided with a plurality of apertures; the upper end of the hollow cage column is closed, and the lower end is open and in communication with a fluid inlet of the dyeing tank through a port of the dyeing tank at the bottom; the upper end of the yarn cage is provided with a sealing cover.

Further, the dye separating unit is mainly composed of a primary and/or a secondary separator and a filter.

Further, the polar medium evaporator and storage unit is mainly composed of an internal heater or a heat exchanger and a storage tank.

Further, the suction cover with negative pressure has an inverted funnel shape, and the open end of the funnel has a size matched with the pressure bearing tank body.

Further, the fiber picking mechanism is mainly composed of a lifting platform and a fiber gripper.

Further, the fiber gripper is connected to the lifting platform and has an angle with the lifting platform, and is symmetrically distributed by a central axis of the cage column or the lifting platform; each fiber gripper is provided with a plurality of working fingers with proportional lengths along the central axis of the lifting platform and the working fingers are arranged in a horizontal direction perpendicular to the central axis of the cage column or the lifting platform.

Further, the lifting platform can be placed on the cage column of the yarn cage during operation, and rotate and lift up and down around the cage column, to drive the fiber gripper to loosen the impacted fiber layers.

Further, the pressure bearing tank body of the fiber dyeing tank is connected to the polar medium pressurizing system and the carbon dioxide medium pressurizing system through a port at the bottom of the pressure bearing tank body, and a polar medium outlet and a mixed fluid medium outlet are provided respectively at a proper location higher than the sealing cover of the yarn cage and lower than the opening of the tank at the upper end of the pressure bearing tank body.

The invention has the following advantages: since there are two sets of pressurizing systems and separating and recycling systems for carbon dioxide medium and polar medium provided in the waterless dyeing machine, dyeing with the mixed fluid medium is realized in the waterless dyeing tank and the dyeing circulation system thereof; in particular, the polar medium in the polar medium pressurizing system effectively modify the hydrophobic carbon dioxide medium, so that the polarity of the mixed fluid medium can be improved, and the natural fibers can be significantly swelled and puffed to provide the necessary conditions for the dye uptake and diffusion in the fibers; at the same time, the modified mixed fluid also greatly improves the solubility of the polar dye molecules and contributes to the adsorption of the dye molecules; a fiber loading system is provided in the waterless dyeing machine, which makes full use of the negative pressure formed by the reverse operation of the bidirectional gas medium booster pump in the polar medium pressurizing system, greatly improving the fiber loading efficiency; and the carbon dioxide separating and recycling system and the polar medium separating and recycling system configured in the dyeing machine can effectively separate and recycle the mixed fluid medium after dyeing, improving the use ratio of the medium; the automatic unloading system improves the discharging efficiency of the products and realizes automation with the intelligent fiber gripper, the suction cover with negative pressure, the fiber conveying pipe and the bidirectional gas medium booster pump.

Therefore, the technology of the present invention can significantly improve the dyeing processing effect and production efficiency of the waterless fiber dyeing, in particular for various types of natural fibers which are not effectively dyed in the hydrophobic supercritical carbon dioxide fluid, which can greatly improve the dyeing performance and obtain good dyeing processing effects. This is of great significance in solving the problem of waterless fluid dyeing of natural fibers. In addition, this promotes the application and industrialization of supercritical fluid waterless dyeing technology in blended fabrics, solves the problem of pollutants generation and emission in the textile printing and dyeing industry radically, and realizes energy saving, emission reduction and cleaning in the textile printing and dyeing industry, which has a very broad application prospect.

Figure 1:
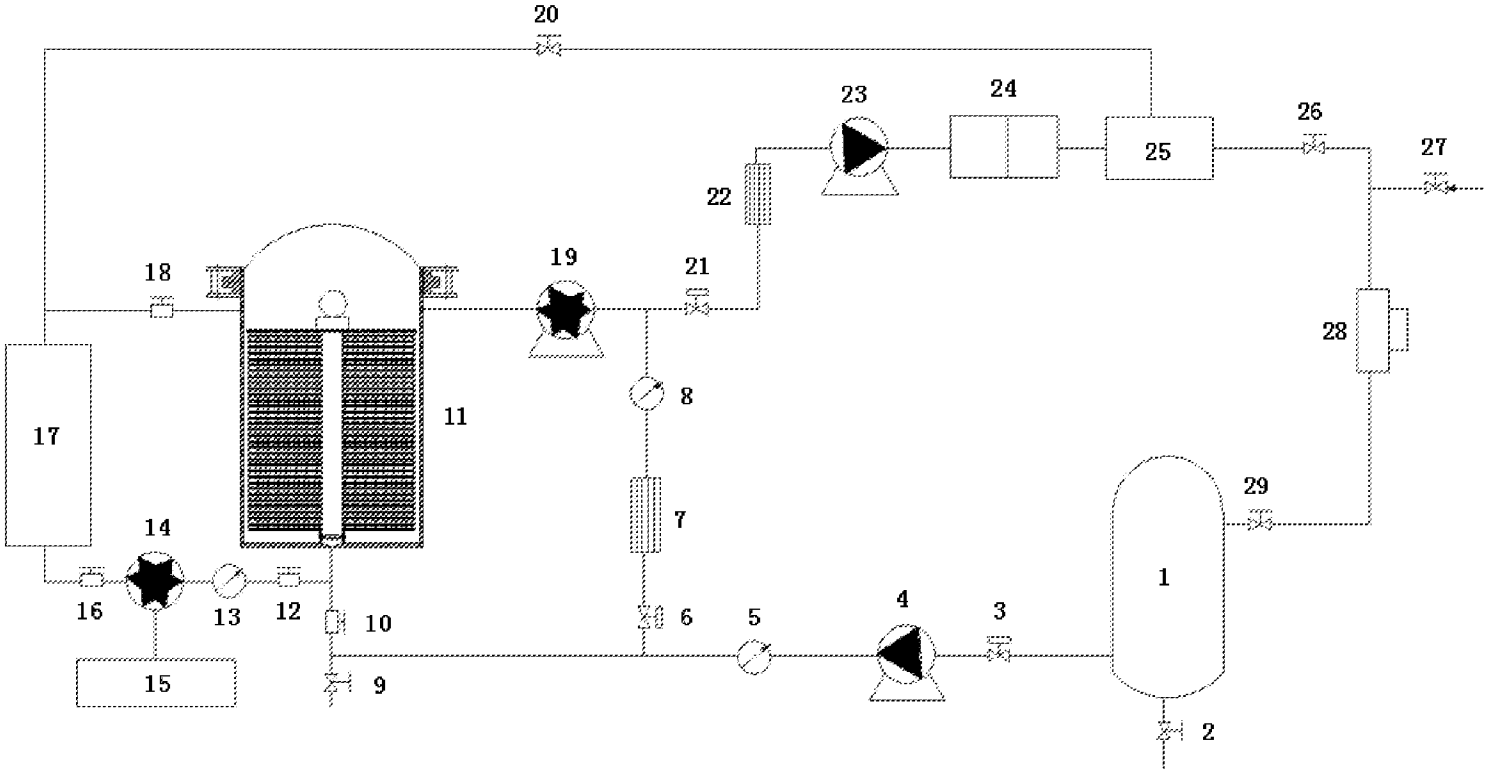
FIG. 1 is a schematic diagram of a waterless dyeing machine suitable for mixed fluid medium according to an embodiment of the present invention.

Reference numbers in the drawings: carbon dioxide storage tank 1; shutoff valves 2, 10, 12, 16, 18, 20, 26, 27, 29; solenoid valves 3, 6, 21; booster pump 4; mass flow meter 5; heat exchangers 7, 22; flow meter 8; gas medium mass flow meter 13; fiber dyeing tank 11; bidirectional gas medium booster pump 14; buffer unit 15; polar medium evaporator and storage unit 17; bidirectional mixed fluid medium circulating pump 19; pressure relief pump 23; dye separating unit 24; mixed fluid separating unit 25; condenser 28; yarn cage 29; cage column 30; yarn cage sealing cover 31; polar medium outlet 32; quick opening structure 33; lifting ring 34; fiber dyeing tank sealing cover 35; mixed fluid medium outlet 36; pressure bearing tank body 37; port for yarn cage and dyeing tank 38; fiber to be dyed 39; dyed fiber 40; fiber picking mechanism 41; suction cover with negative pressure 42; fiber conveying pipe 43; central axis of the cage column 44; automatic lifting platform 45; fiber gripper 46; working fingers 47; horizontal line perpendicular to the central axis of the cage column 48.

DETAILED DESCRIPTION OF THE EMBODIMENTS

The present invention will be further described in reference with the drawings and specific embodiments, so that those skilled in the art can understand the invention better and implement it, but these embodiments are not intended to limit the invention.

As shown in FIG. 1 to FIG. 6, a waterless fiber dyeing machine suitable for mixed fluid medium, including a fiber dyeing tank 11 suitable for waterless fiber dyeing with high-pressure mixed fluid, a carbon dioxide medium pressurizing system, a polar medium pressurizing system, a fiber loading system, a circulating dyeing system, a carbon dioxide separating and recycling system, a polar medium separating and recycling system, an automatic unloading system.

Wherein, an inlet of the fiber dyeing tank 11 is respectively connected with the carbon dioxide medium pressurizing system and the polar medium pressurizing system, and an outlet is connected with the carbon dioxide separating and recycling system and the polar medium separating and recycling system, and an inlet and an outlet of the circulating dyeing system are respectively connected with the inlet and outlet of the fiber dyeing tank, wherein the automatic unloading system can be detachably fitted with the fiber dyeing tank 11, and when unloading is operated, the automatic unloading system is connected to the fiber dyeing tank 11, thereby the fibers in the fiber tank 11 are unloaded.

The fiber dyeing tank 11 includes an inner matched yarn cage 29 and a pressure bearing tank body 37.

The carbon dioxide medium pressurizing system is mainly composed of a mass flow meter 5, a booster pump 4, and a carbon dioxide storage tank 1 which are sequentially connected to the fiber dyeing tank 11.

The polar medium pressurizing system is mainly composed of a polar medium evaporator and storage unit 17, a bidirectional gas medium booster pump 14, and a gas medium mass flow meter 13 which are sequentially connected to the fiber dyeing tank 11.

The fiber loading system is mainly composed of the bidirectional gas medium booster pump 14, the mass flow meter 5, a buffer unit 15 and a mechanical loading mechanism, and the mechanical loading mechanism is used for loading the fiber dyeing tank 11 with the fibers to be dyed.

The circulating dyeing system is mainly composed of the fiber dyeing tank 11, a bidirectional mixed fluid medium circulating pump 19, a heat exchanger 22, and a flow meter 8 connected in sequence.

The carbon dioxide separating and recycling system is mainly composed of the heat exchanger 22, a pressure relief pump 23, a dye separating unit 24, a mixed fluid separating unit 25, a condenser 25, and a carbon dioxide storage tank 1 which are sequentially connected to the fiber dyeing tank 11.

The polar medium separating and recycling system is mainly composed of a mixed fluid separating unit 25 and a polar medium evaporator and storage unit 17 which are sequentially connected.

The automatic unloading system is mainly composed of a suction cover 42 with negative pressure, a fiber conveying pipe 43, a fiber picking mechanism 41, the bidirectional gas medium boosting pump 14, and the buffer unit 15.

The high-pressure mixed fluid has a pressure of 30 MPa or more.

The mixed fluid is composed of two or more fluid components, one of which is supercritical carbon dioxide.

The mixed fluid is composed of two or more fluid components, at least one of which is a polar medium such as water vapor or other polar medium.

The matched yarn cage 29 is made of a non-conductive surface material, such as Teflon, and the cage 29 includes a cylindrical cage body and a hollow cage column 30; the surface and bottom of the cylindrical cage 29 and the hollow cage column are provided with a plurality of apertures; the upper end of the hollow cage column is closed, and the lower end is open and in communication with a fluid inlet of the dyeing tank through a port of the dyeing tank at the bottom; the upper end of the yarn cage 29 is provided with a sealing cover.

The dye separating unit 24 is mainly composed of a primary and/or a secondary separator and a filter.

The polar medium evaporator and storage unit 17 is mainly composed of an internal heater or a heat exchanger and a storage tank.

The suction cover 42 with negative pressure has an inverted funnel shape, and the open end of the funnel has a size matched with the pressure bearing tank body 37, and can be matched with the opening of the pressure bearing tank body 37 during operation; the suction cover 42 with negative pressure is connected to an external fan through the fiber conveying pipe 43.

The fiber picking mechanism 41 is mainly composed of a lifting platform 45 and a fiber gripper 46.

The fiber gripper 46 is inclined downwardly and connected to the lifting platform 45 at a certain horizontal angle θ (0-180°, and is symmetrically distributed by a central axis of the cage column 30 or the lifting platform 45; each fiber gripper 46 is provided with a plurality of working fingers 47 of proportional lengths along the central axis of the lifting platform 45 and the working fingers 47 are arranged in a horizontal direction perpendicular to the central axis of the cage column 30 or the lifting platform 45.

The lifting platform 45 can be placed on the cage column 30 of the yarn cage 29 during operation, and rotate and lift up and down around the cage column 30, to drive the fiber gripper 46 to loosen the impacted fiber layers.

The pressure bearing tank body 37 of the fiber dyeing tank 11 is connected to the polar medium pressurizing system and the carbon dioxide medium pressurizing system through a port at the bottom of the pressure bearing tank body, and a polar medium outlet 32 and a mixed fluid medium outlet 36 are provided respectively at a proper location higher than the sealing cover 31 of the yarn cage and lower than the opening of the tank at the upper end of the pressure bearing tank body.

The carbon dioxide separating and recycling system and the polar medium separating and recycling system cooperate to separate and recycle the mixed fluid in the fiber dyeing tank 11 to $1.01\times10^5$ Pa, and the dyeing tank is opened directly.

As shown in FIG. 1 to FIG. 6, in an embodiment of the present application, each valve is disposed as follows: the shutoff valve 12 is disposed at a junction of the mixed fluid inlet 36 and the polar medium pressurizing system, and the shutoff valve 10 is disposed at a junction of the mixed fluid inlet 36 and the carbon dioxide medium pressurizing system. A solenoid valve 6 is disposed at a junction of the heat exchanger 7 and the carbon dioxide medium pressurizing system. In the circulation pipeline, a solenoid valve 21 is provided between the fluid circulation pump 19 and the heat exchanger 22. A shutoff valve 26 is provided between the mixed fluid flow separating unit 25 and the condenser 28, and a shutoff valve 29 is provided between the condenser 28 and the carbon dioxide storage tank 1. In addition, a shutoff valve 20 is disposed between the mixed fluid flow separating unit and the polar medium evaporator and storage unit. The bottom end of the carbon dioxide storage tank 1 is further provided with a shutoff valve 2, and a branch is provided between the shutoff valve 26 and the condenser 28. The branch is provided with a shutoff valve 27, and a branch is provided between the shutoff valve 10 and the mass flow meter 5, on which a shutoff valve 9 is provided.

Figure 2:
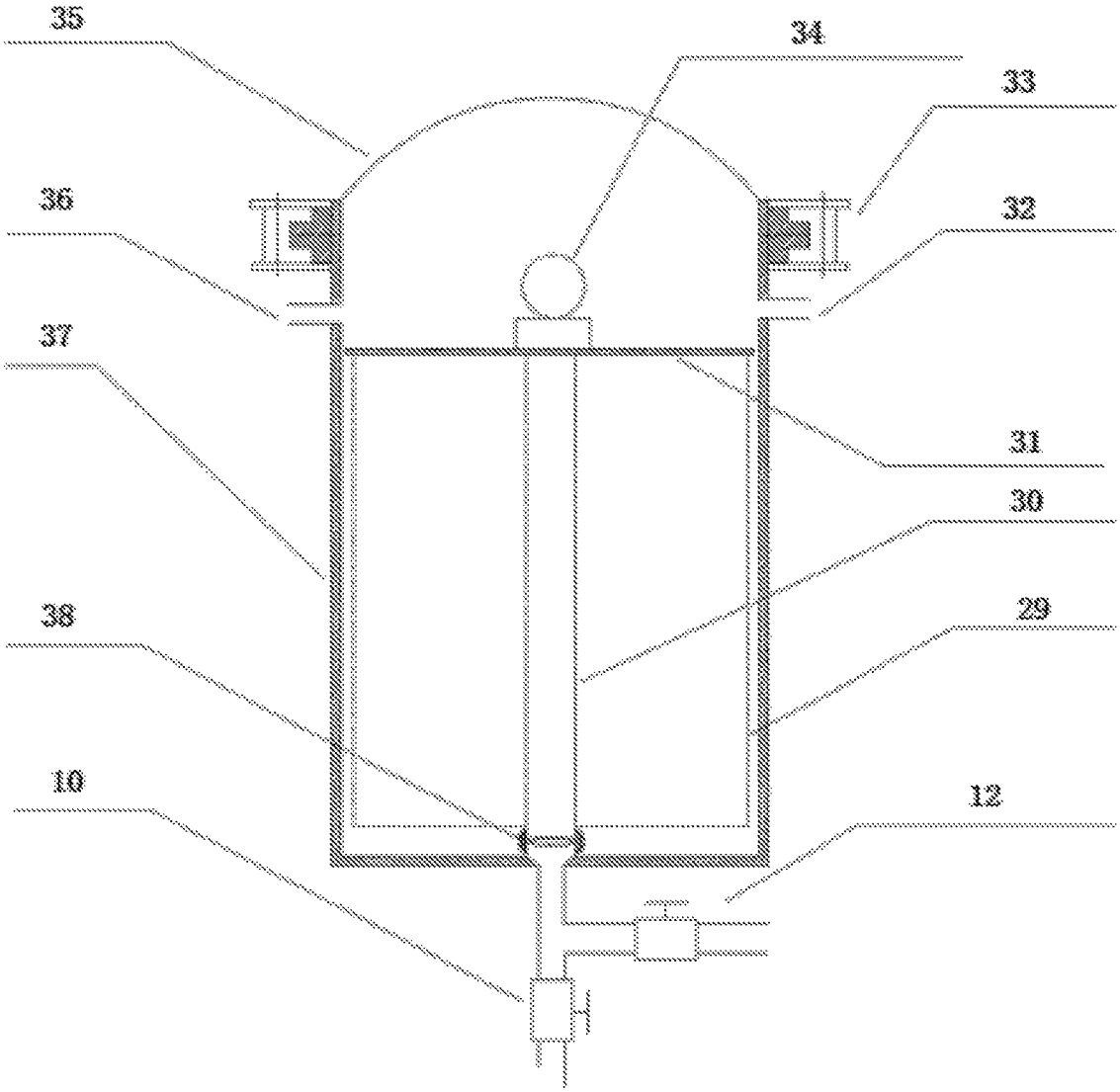
FIG. 2 is a schematic view showing the overall structure and longitudinal section view of a dyeing tank of a waterless dyeing machine suitable for mixed fluid medium according to an embodiment of the present invention.
Figure 3:
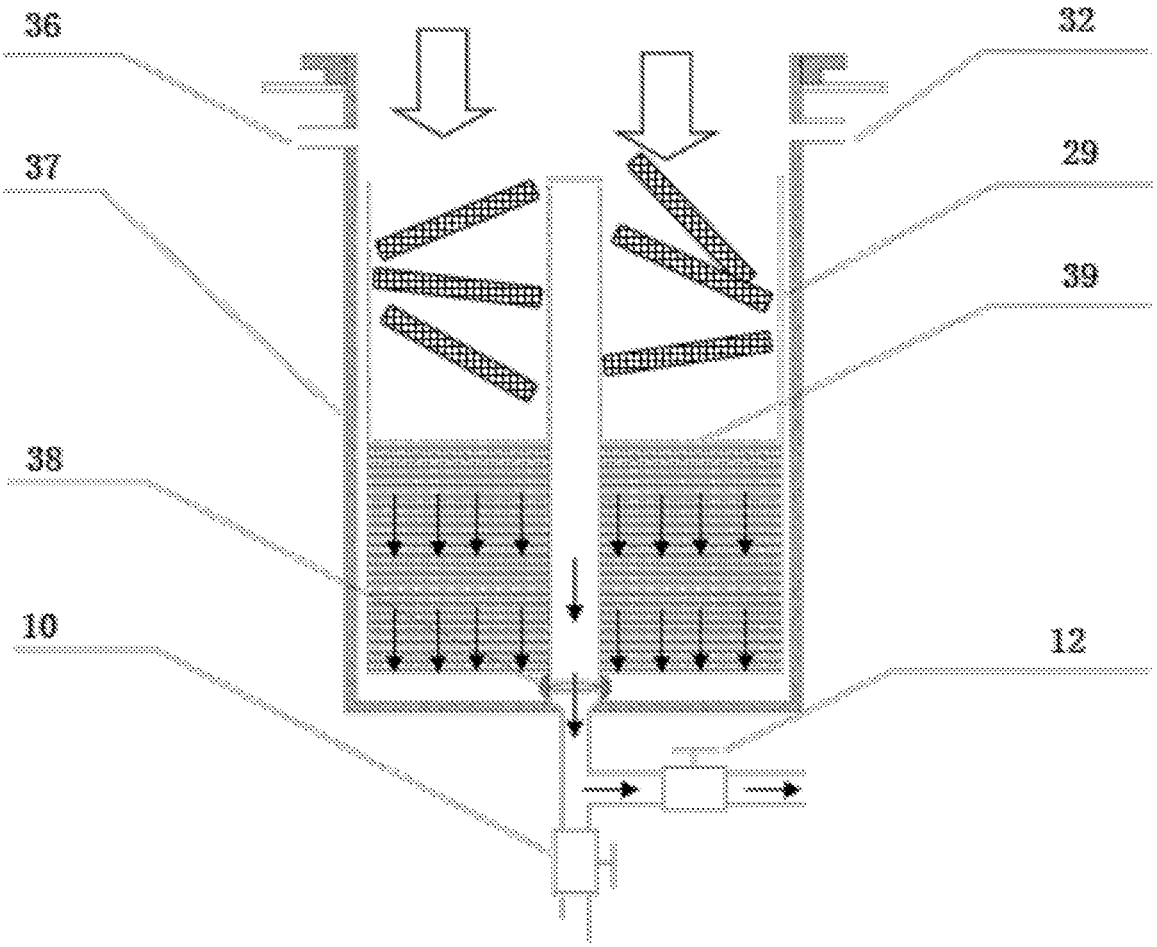
FIG. 3 is a schematic view showing the longitudinal section view of a dyeing tank of a waterless dyeing machine suitable for mixed fluid medium according to an embodiment of the present invention during fiber loading.
Figure 4:
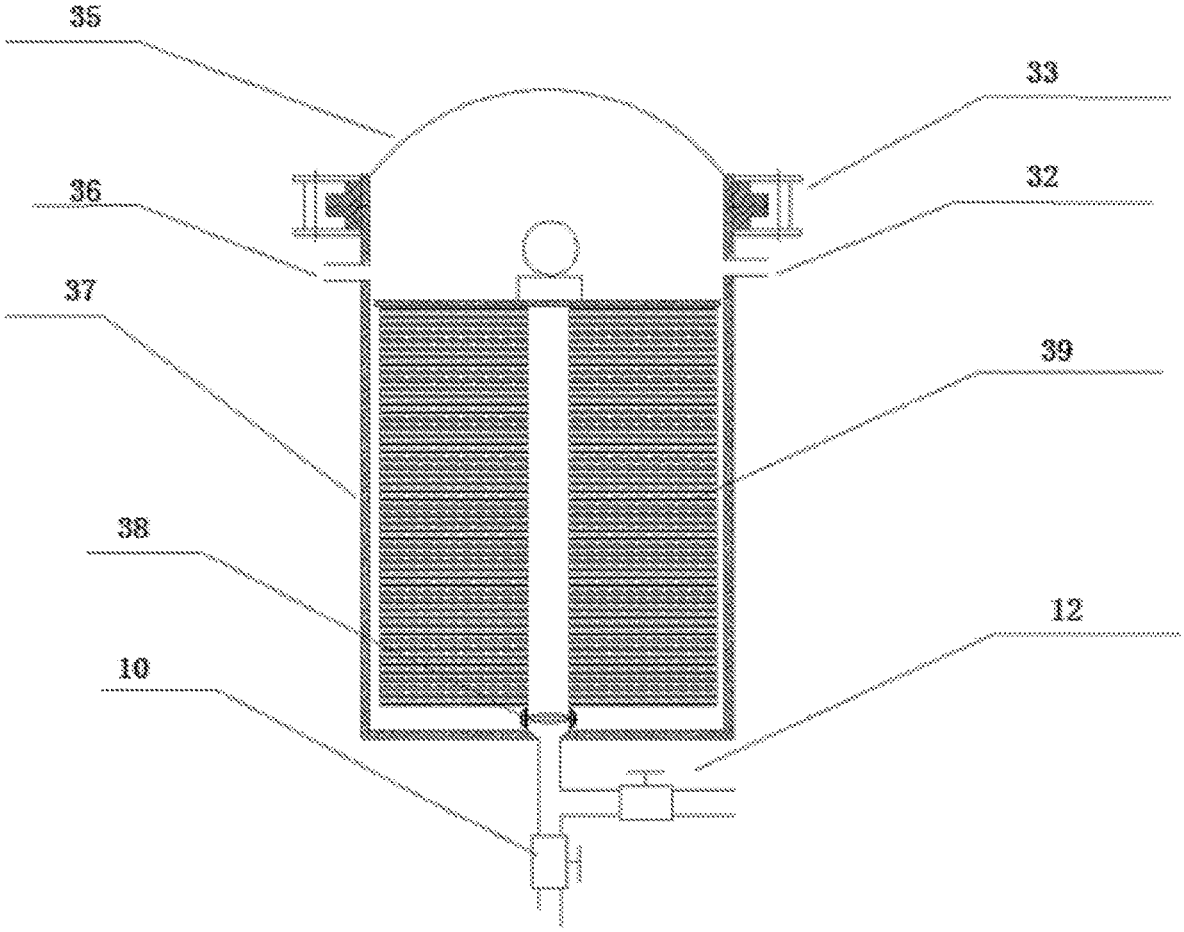
FIG. 4 is a schematic view showing the longitudinal section view of a dyeing tank of a waterless dyeing machine suitable for mixed fluid medium according to an embodiment of the present invention after fiber loading.

As shown in FIG. 1 to FIG. 6, when the waterless fiber dyeing machine suitable for mixed fluid medium in the present invention works, the sealing cover 35 of the pressure bearing tank body 37 in FIG. 2 and the yarn cage sealing cover 31 are first opened. The yarn cage 29 in the dyeing tank is treaded using a fiber loading system consisting of the bidirectional gas medium booster pump 14, the mass flow meter 13, the buffer unit 15, and the external mechanical loading mechanism. With the reverse operation of the bidirectional gas medium booster pump 14, a negative pressure is formed in the dyeing tank, which greatly improves the efficiency and effectiveness of fiber loading on the dry fiber layers 39 to be dyed. The working principle of the fiber loading is shown in FIG. 3. The fibers to be dyed are placed in the dyeing tank layer by layer, and then the fibers are mechanically pressed downwardly. According to the predetermined production and process requirements, after the fiber loading in the fiber dyeing tank 11 is finished, the yarn cage sealing cover 31 and a lifting ring 34 are attached and fixed at the upper end of the yarn cage. Then, the pressure bearing tank body 37 is sealed by the quick open structure 33 of the dyeing tank and the fiber dyeing tank sealing cover 35, and the dyeing tank is integrally assembled with reference to FIG. 2. The dyeing tank to be processed after fiber loading and the overall assembly and its longitudinal section are shown in FIG. 4. Then, the solenoid valve 21, the shutoff valves 18, 19, 20 are closed, and the shutoff valves 10, 12, 16 and the solenoid valves 6, 3 are opened; finally, the booster pump 4 and the bidirectional gas medium booster pump 14 are turned on respectively or simultaneously. According to the process requirements, a carbon dioxide medium pressurizing system composed of a mass flow meter 5, a booster pump 4, a carbon dioxide storage tank 1, and a polar medium pressurizing system composed of a polar medium evaporator and storage unit 17, a bidirectional gas medium booster pump 14, and a gas medium mass flow meter 13 are used to pressurize the mixed fluid medium in a predetermined proportion on the fiber dyeing tank 11.

After the pressurizing to the mixed fluid medium is done, the booster pump 4, the bidirectional gas medium booster pump 14, and the shutoff valves 12, 16 are closed. Then the bidirectional mixed fluid medium circulation pump 19 is turned on, and a mixed fluid medium containing dye placed in advance is circulated by a circulating dyeing system composed of a fiber dyeing tank 11, a bidirectional mixed fluid medium circulating pump 19, a heat exchanger 7, and a flow meter 8, so that waterless fiber dyeing to the fibers is done. At the same time, it is also possible to process the fibers in the dyeing tank in two directions by using the reversing function of the bidirectional mixed fluid medium circulation pump 19.

After the dyeing is finished, the bidirectional mixed fluid medium circulation pump 19 can be stopped, and the shutoff valves 26, 29, the condenser 28, and the solenoid valve 21 are sequentially turned on, and the carbon dioxide medium, the polar medium, and the residual dye in the circulating dyeing system are separated and the residual dye and the carbon dioxide medium are recycled by the carbon dioxide separating and recycling system composed of the heat exchanger 22, the pressure relief pump 23, the dye separating unit 24, the mixed fluid separating unit 25, the condenser 28, and the carbon dioxide storage tank 1. Finally, after the recycling of the carbon dioxide medium is completed, the shutoff valve 20 is opened, and the polar medium separated in the mixed fluid separating unit 25 is recycled by the polar medium separating and recycling system composed of the mixed fluid separating unit 25, the polar medium evaporator and storage unit 17. In addition, according to the process and product requirements, in the stage of finishing dyeing and separating and recycling the carbon dioxide medium, the processed products in the dyeing tank and dyeing circulation system are cleaned by using the carbon dioxide medium pressurizing system and/or the polar medium pressurizing system, so that the quality requirements such as color fastness of the product, as well as the requirements of the dyeing system itself for subsequent dyeing processing is met.

Figure 5:
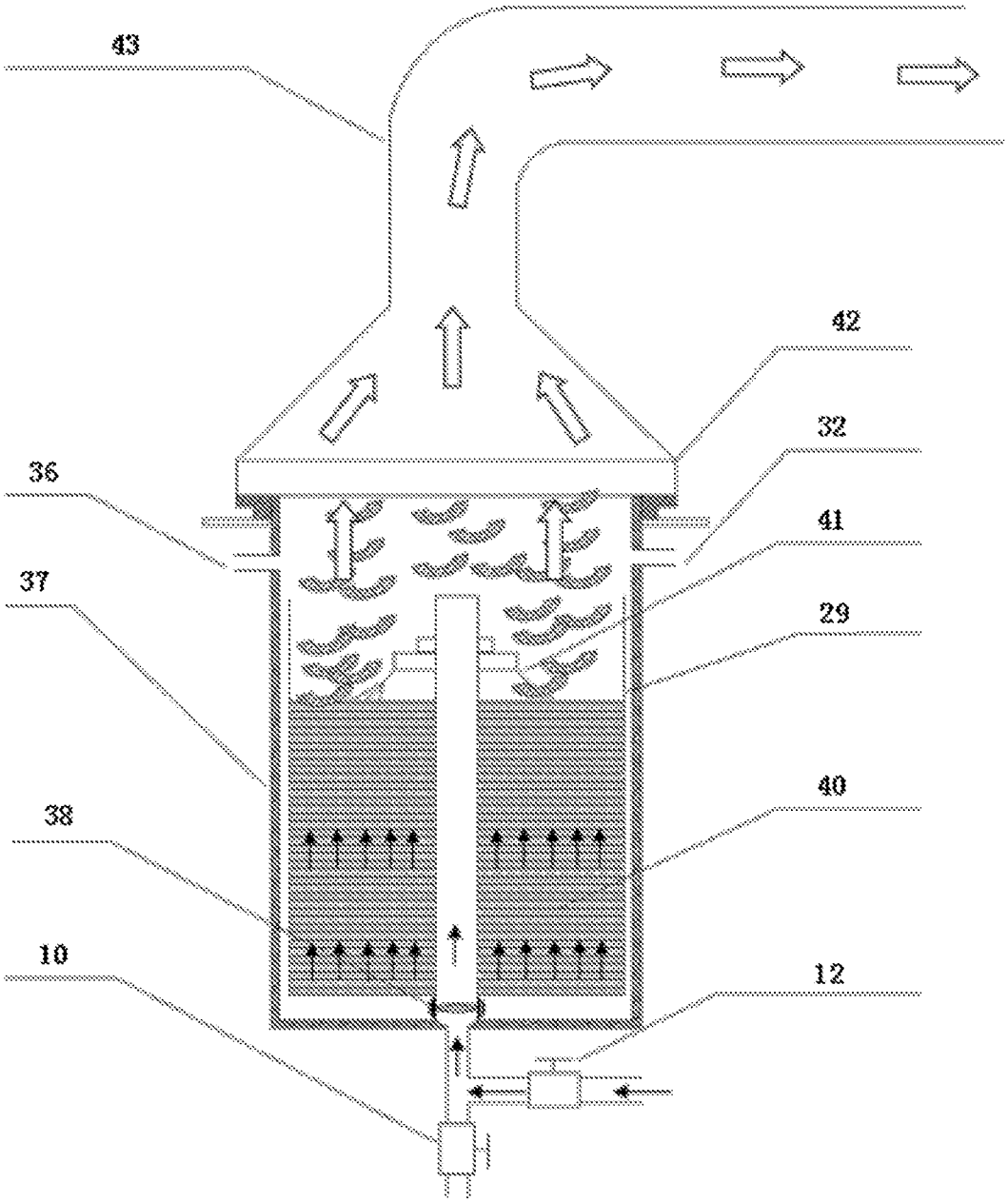
FIG. 5 is a schematic diagram of an unloading system of a waterless dyeing machine suitable for mixed fluid medium according to an embodiment of the present invention.
Figure 6:
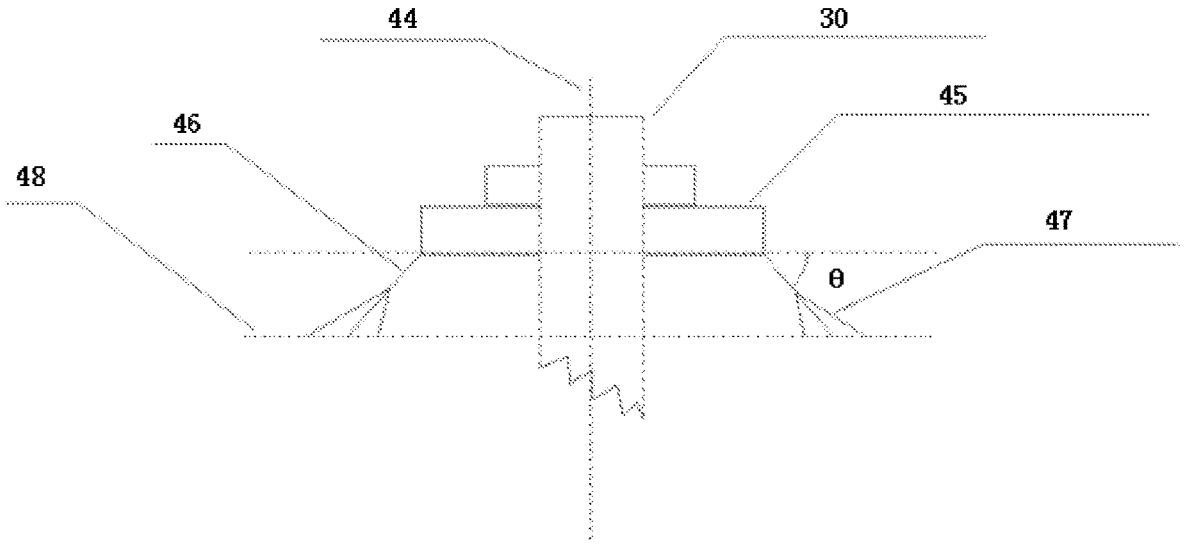
FIG. 6 is a schematic view showing the longitudinal section view of an intelligent fiber gripper of a waterless dyeing machine suitable for mixed fluid medium according to an embodiment of the present invention.

After the dyeing process and its post-process are finished, especially after the medium in the dyeing circulation system is separated and recycled, the system pressure is reduced to atmospheric pressure of $1.01\times10^5$ Pa, the pressure relief pump 23 stops working, and the solenoid valve 21 is closed. The dyeing tank can be opened by a quick opening structure 33 on the dyeing tank. Subsequently, the yarn cage sealing cover 31 at the upper end of the yarn cage is opened, and the automatic lifting platform 45 of the intelligent fiber picking mechanism 41 is assembled to the upper end of the cage column 30, and the working fingers 47 of the intelligent fiber gripper 46 is in optimal contact with the layers 40 of the dyed fibers. Further, the suction cover 42 with negative pressure is combined with the opening of the pressure bearing tank body 37, and the fibers are picked and loosened by the working fingers 47 of the intelligent gripper 46 along a horizontal plane 48 perpendicular to the central axis of the cage column driven by the downward movement on the cage column 30 of automatic lifting platform 45 of the intelligent fiber picking mechanism 41 and the rotational movement around the central axis of the cage column. The dry dyed fibers after picking and loosening are discharged and unloaded through the fiber conveying pipe 43 under the suction of the suction cover 42 with negative pressure. At the same time, in order to improve the working efficiency of the automatic unloading system, the bidirectional gas medium booster pump 14 and the buffer unit 15 can be used to assist the loosening of the fiber layers in the yarn cage to improve the loosening and discharging efficiency of the fiber layers. The related assembly, structure and working principle are shown in FIG. 5 and FIG. 6. Finally, until all the dyed fibers 40 in the yarn cage 29 are discharged, a waterless dyeing process with the mixed fluid medium under a predetermined process condition is completed.

By repeating the above operation, the subsequent waterless dyeing processing with the mixed fluid medium can be continued.

The embodiments described above are merely preferred embodiments for the purpose of fully illustrating the invention, and the scope of the invention is not limited thereto. Equivalent substitutions or modifications made by those skilled in the art based on the present invention are within the scope of the present invention. The scope of the invention is defined by the claims.

The invention claimed is:

1. A waterless fiber dyeing machine suitable for mixed fluid medium, comprising a fiber dyeing tank suitable for waterless fiber dyeing with high-pressure mixed fluid, a carbon dioxide medium pressurizing system, a polar medium pressurizing system, a fiber loading system, a circulating dyeing system, a carbon dioxide separating and recycling system, a polar medium separating and recycling system, and an automatic unloading system, wherein an inlet of the fiber dyeing tank is respectively connected to the carbon dioxide medium pressurizing system, the polar medium pressurizing system and the fiber loading system, an outlet of the fiber dyeing tank is connected to the carbon dioxide separating and recycling system and the polar medium separating and recycling system, and an outlet and an inlet of the circulating dyeing system are respectively connected to the inlet and the outlet of the fiber dyeing tank, and the automatic unloading system is detachably fitted with the fiber dyeing tank, when unloading is operated, the automatic unloading system is connected with the fiber dyeing tank to unload the fibers in the fiber dyeing tank;

wherein the carbon dioxide medium pressurizing system and the polar medium pressurizing system are two separate sets of pressurizing systems;

wherein the carbon dioxide medium pressurizing system mainly comprises a mass flow meter, a booster pump and a carbon dioxide storage tank which are connected in series, wherein the inlet of the fiber dyeing tank is in communication with the mass flow meter;

wherein the polar medium pressurizing system comprises a polar medium evaporator and storage unit, a bidirectional gas medium booster pump and a gas medium mass flow meter which are connected in series, wherein the gas medium mass flow meter is in communication with the inlet of the fiber dyeing tank;

wherein the fiber dyeing tank mainly comprises a pressure bearing tank body and a yarn cage disposed inside the tank body;

wherein the automatic unloading system comprises a suction cover with negative pressure, a fiber conveying pipe and a fiber picking mechanism, the suction cover with negative pressure can be fitted with an opening of the pressure bearing tank body, and the suction cover with negative pressure is connected with an external fan through the fiber conveying pipe;

wherein the fiber picking mechanism is mainly composed of a lifting platform and a fiber gripper; and wherein the fiber gripper is inclined downwardly and connected to the lifting platform at a certain horizontal angle 0-180°, and is symmetrically distributed by a central axis of the cage column or the lifting platform; each fiber gripper is provided with a plurality of working fingers along the central axis of the lifting platform and the working fingers are arranged in a horizontal direction perpendicular to the central axis of the cage column or the lifting platform; and wherein the lifting platform is placed on the cage column of the yarn cage during operation, and rotate and lift up and down around the cage column, to drive the fiber gripper to loosen impacted fiber layers.

2. The waterless fiber dyeing machine suitable for mixed fluid medium according to claim 1, wherein the fiber loading system is mainly composed of the bidirectional gas medium booster pump, the mass flow meter, a buffer unit and an external mechanical loading mechanism configured to load the fiber dyeing tank with fibers to be dyed.

3. The waterless fiber dyeing machine suitable for mixed fluid medium according to claim 1, wherein the circulating dyeing system mainly comprises a bidirectional mixed fluid medium circulating pump, a heat exchanger and a flow meter which are connected in series, wherein the fiber dyeing tank, the bidirectional mixed fluid medium circulation pump, the heat exchanger, and the flow meter are sequentially connected to form circulation.

4. The waterless fiber dyeing machine suitable for mixed fluid medium according to claim 1, wherein the carbon dioxide separating and recycling system mainly comprises a heat exchanger, a pressure relief pump, a dye separating unit, a mixed fluid separating unit, a condenser which are connected in series, wherein the heat exchanger is connected to the fiber dyeing tank, and the condenser is connected to the carbon dioxide storage tank.

5. The waterless fiber dyeing machine suitable for mixed fluid medium according to claim 4, wherein the polar medium separating and recycling system comprises a pipeline for connecting the mixed fluid separating unit and the polar medium evaporator and storage unit.

6. The waterless fiber dyeing machine suitable for mixed fluid medium according to claim 4, wherein the dye separating unit mainly comprises a primary and/or a secondary separator and a filter.

7. The waterless fiber dyeing machine suitable for mixed fluid medium according to claim 1, wherein the high-pressure mixed fluid has a pressure higher than 30 MPa.

8. The waterless fiber dyeing machine suitable for mixed fluid medium according to claim 1, wherein the mixed fluid is composed of two or more fluid components, one of which is supercritical carbon dioxide.

9. The waterless fiber dyeing machine suitable for mixed fluid medium according to claim 1, wherein the mixed fluid is composed of two or more fluid components, at least one of which is a polar media.

10. The waterless fiber dyeing machine suitable for mixed fluid medium according to claim 1, wherein the yarn cage is made of a surface material which is non-conductive, and comprises a cylindrical cage body and a hollow cage column; the surface and bottom of the cylindrical cage body and the hollow cage column are provided with a plurality of apertures; the upper end of the hollow cage column is closed, and the lower end is open and in communication with a fluid inlet of the dyeing tank through a port of the dyeing tank at the bottom; the upper end of the yarn cage is provided with a sealing cover.

11. The waterless fiber dyeing machine suitable for mixed fluid medium according to claim 1, wherein the polar medium evaporator and storage unit is mainly composed of an internal heater or a heat exchanger and a storage tank.

12. The waterless fiber dyeing machine suitable for mixed fluid medium according to claim 1, wherein the suction cover with negative pressure has a shape of an inverted funnel, and the open end of the funnel has a size matched with the pressure bearing tank body.

13. The waterless fiber dyeing machine suitable for mixed fluid medium according to claim 1, wherein the pressure bearing tank body of the fiber dyeing tank is connected to the polar medium pressurizing system and the carbon dioxide medium pressurizing system through an inlet at the bottom of the pressure bearing tank body, and a polar medium outlet and a mixed fluid medium outlet are provided respectively at a position higher than the sealing cover of the yarn cage and lower than the opening of the tank at the upper end of the pressure bearing tank body.

14. The waterless fiber dyeing machine suitable for mixed fluid medium according to claim 1, wherein the carbon dioxide separating and recycling system, the polar medium separating and recycling system cooperate to separate and recycle the mixed fluid in the fiber dyeing tank to $1.01\times10^5$ Pa, so that the dyeing tank is opened directly.

* * * * *